US006004204A

United States Patent [19]

Luxton et al.

[11] Patent Number: 6,004,204

[45] Date of Patent: Dec. 21, 1999

[54] INDUCTION NOZZLE AND ARRANGEMENT

[75] Inventors: Russell Estcourt Luxton; Vladimir Miodrag Petrovic, both of Adelaide, Australia

[73] Assignee: Luminis PTY Ltd., Adelaide, Australia

[21] Appl. No.: 08/913,207

[22] PCT Filed: Mar. 11, 1996

[86] PCT No.: PCT/AU96/00129

§ 371 Date: Sep. 10, 1997

§ 102(e) Date: Sep. 10, 1997

[87] PCT Pub. No.: WO96/28697

PCT Pub. Date: Sep. 19, 1996

[30] Foreign Application Priority Data

Mar. 10, 1995 [AU] Australia ..... PN1646

[51] Int. Cl.[6] ..... F24F 13/04

[52] U.S. Cl. ..... 454/263; 454/261

[58] Field of Search ..... 454/261, 262, 454/263, 305, 906

[56] References Cited

U.S. PATENT DOCUMENTS

| | | | |
|---|---|---|---|
| 3,409,274 | 11/1968 | Lawton | 454/261 |
| 4,448,111 | 5/1984 | Doherty | 454/261 |
| 4,665,804 | 5/1987 | Miyasaka | 454/261 |
| 5,197,920 | 3/1993 | Ganse | 454/228 |

FOREIGN PATENT DOCUMENTS

| | | | |
|---|---|---|---|
| 361161335A | 7/1986 | Japan | 454/261 |

*Primary Examiner*—Harold Joyce
*Assistant Examiner*—Derek Boleg
*Attorney, Agent, or Firm*—Klauber & Jackson

[57] ABSTRACT

This invention relates to an induction air handling unit of the type that uses a primary air flow to induce flow of secondary air through the air handling unit. It comprises an induction chamber (2) having an air flow entrance (22) and an air flow exit (23) and a nozzle (10) having an outlet (12) located within the induction chamber (20). The nozzle (10) is connected to a primary air flow that causes a secondary air flow to be induced through the induction chamber (20) via the entrance (22) and the exit (23). The nozzle (10) is characterized by the edge (12) forming an outlet that is of a scalloped shape. This has a dramatic effect on producing noise output from the nozzle (10).

15 Claims, 3 Drawing Sheets

INDUCTION NOZZLE AND ARRANGEMENT

BACKGROUND OF THE INVENTION

This invention relates to an induction air handling unit, and in particular a nozzle design for an induction air handling unit.

When a gas is discharged from a duct or when it flows through a restriction in a duct, the momentum of the jet is dissipated through mixing with the downstream surroundings. A by-product of this process is the generation of noise which is radiated to the surroundings. It is well established that the sound power which is generated increases at approximately the eighth power of the jet velocity. The efficiency with which it is radiated into the far field of the surroundings depends strongly on both the rate and the scale of the mixing. For a turbulent jet of given mass flow emerging from an orifice of given cross-sectional area, the total sound power radiated decreases as the rate of mixing of the jet with the surroundings increases.

For many years it has been known that the theory of aerodynamic noise generation from turbulent shear flows advanced by Sir James Lighthill, and published in the Proceedings of The Royal Society of London, (On *sound generated aerodynamically,* Proc. Roy. Soc. A211, p.564, 1952—see also: *Waves in fluids, Cambridge University Press,* 1978) is incomplete in that it fails to yield reliable predictions of the noise generated by jets at low Mach number. The incompleteness of the Lighthill theoretical model is understandable when it is realised that it was devised before the discovery by G. L. Brown and A. Roshko (*Journal of Fluid Mechanics,* 64, 775–816, 1974) that the growth of the mixing layer, from which most of the noise emanates, is not continuous but is dominated by the formation of seemingly deterministic vortex-like structures of a scale which is comparable to or larger than the local thickness of the shear layer, and their non-deterministic, intermittent growth by a succession of "amalgamations" between themselves which appear to be little influenced by the turbulent shear layer which they wrap into their structures like jam into a Swiss roll. The magnitude of the disturbances in the flow is many times that which occurs in a simple turbulent shear flow and hence it is reasonable to surmise that these Brown-Roshko vortices may be generating much of the noise. Recent research by Professor N. W. M. Ko and his student Mr R. C. K. Leung at The University of Hong Kong, which has been submitted for publication in the Journal of Sound and Vibration, has advanced a new concept of the noise generation mechanism based on this surmise. The new concept derives from measurements of the processes by which successive Brown-Roshko vortex structures in the shear layer between the jet and the surroundings "pair" together causing the large scale folding, mixing and the intermittent expansion of the jet cross-section. Ko and Leung have found that if a vortex "ring" formed in the mixing layer at the edge of an axisymmetric jet is to "pair" with its predecessor, it must be accelerated rapidly by the pressure field of the leading vortex until it passes through the "eye" of that leading vortex. It is then rapidly retarded and the two vortices merge to become a single larger vortex. The process can be likened to an "extrusion" of the trailing vortex through the eye of the leading vortex. During this "extrusion" process the rates of change of the acceleration of the trailing vortex are very large. In the subject of Mechanics the rate of change of acceleration is known as the "jerk". It is expressed mathematically as the third derivative of distance with respect to time. (It will be recalled that the first derivative of distance with respect to time is the velocity and the second derivative is the acceleration. In solid mechanics it is well known that "jerk" is frequently accompanied by noise; the collision of two marbles and the tapping of a pencil on a table are typical examples). Associated with this extrusion process is a distortion of the shape of the trailing vortex from a nearly circular doughnut shape into a scalloped shape bearing similarities to the nozzle described herein.

The present invention relates to the design of nozzles which stimulate the rapid mixing of jets which discharge into either free or confined surroundings. Of particular interest is the discharge of conditioned air through nozzles for the purposes of cooling or heating a space. An example of this application which involves discharge into "free" surroundings is the "spot cooling" provided for passengers in aircraft. In this application the background noise level is such that the low level of noise achieved by the subject nozzle is of secondary importance compared with the feature of enhanced mixing with the air in the aircraft cabin. A high rate of mixing will allow the same degree of cooling with a smaller quantity of air supplied at a lower temperature than is used in present practice. This would both save energy and produce a more comfortable local cooling around the head and face of passengers without there being an aggressive draught. When applied to the main air conditioning outlets in the aircraft cabin the enhanced mixing and lower temperature of the supply air would also reduce the volume of air needed to cool the cabin when the aircraft is on the ground in a hot climate, or a higher temperature could be used to heat the aircraft when in flight or on the ground in a cold climate.

Other applications of a similar nature are the "spot" cooling or heating of the driver of, for example, an agricultural tractor, a fork lift truck, an excavator, a Load-Haul-Dump vehicle above or below ground, and a crane, among many others. The driver and passengers or crew of a bus, a heavy transport vehicle, a rail vehicle, an armoured military vehicle, an automobile or other transport vehicle would also benefit from the use of the present nozzles in the conditioned air supply system. Again, in these examples the background noise level is high and the low noise characteristic of the subject nozzle is of secondary interest relative to its ability to achieve rapid mixing of the primary air jet with the surroundings. This ability allows the conditioned air to be admitted close to the occupant of the vehicle without producing an undesirable level of draught. Other applications of the nozzles, in all of which excessive draught is undesirable and in most of which a low level of noise is desirable, are exemplified by "spot" cooling or heating of personal work spaces within a factory, an office, a space craft or a submarine, the cooling of electronic components or equipment, the cooling of processes and mechanisms.

An induction air conditioning system relies on the discharge through nozzles as jets of a first or primary stream of cooled and dehumidified, or heated and if necessary humidified air into a confined space within an induction air conditioning unit before discharging to the conditioned space, herein referred to as the room. One boundary of the confined space within the induction unit takes the form of heat exchange means through which a secondary stream of air, originating from the room, is drawn to replace the quantity of air from within said confined space which is entrained into the primary air jet or jets. This occurs naturally because the entrainment by the primary air jet or jets causes the static pressure in the confined space to be reduced below the pressure surrounding the induction unit. The psychrometric state of the secondary stream of air may be changed as it passes through the heat exchange means. The mixture of the primary air and the secondary air streams is then discharged into said conditioned space to provide the required cooling or heating and to provide ventilation.

In such induction air conditioning systems the primary air stream usually consists of air from outside the building often, but not necessarily, mixed with a proportion of air returned from the conditioned space. This primary air is treated in one or more primary air treatment plants before it is ducted to the induction units so that, after having been mixed with the induced secondary air stream within the induction air conditioning units, it is at the temperature and humidity ratio necessary to offset the sensible and latent heat loads in the conditioned space. When used in conjunction with the invention described in Australian Patent 662336 entitled *Air conditioning for humid climates,* which is now commonly referred to as the *High Driving Potential,* or *HDP* system, the primary air can be deeply cooled and dehumidified before being mixed with the entrained secondary air from the room. The efficient mixing produced by the jets from the multi-lobe nozzles will ensure that the air mixture which reaches the occupants is at the desired temperature and moisture content. The most common application of induction air conditioning systems is to condition the air in the space bounded by the building perimeter walls and an often imaginary line some 3 to 6 meters in from said perimeter walls on each level of the building.

The space so defined is referred to as the perimeter zone. A perimeter zone may be physically defined by partitioned offices or may be open space which merges with the interior zone of the building. A conventional air conditioning system usually feeds the whole of the treated air, at modest pressure, from a plant room or air supply shaft through ducts mounted above the ceiling, and thence to ceiling mounted supply air registers distributed throughout the space. Such supply air ducts, because they convey the whole of the conditioned supply air at low pressure, necessarily have relatively large cross-sections. In combination with the depth of the structural beams associated with the floor slab of the next level of the building, they set the required height of the ceiling space and therefore have a determining influence on the required slab-to-slab spacing. In many cities or parts of cities a height restriction is placed on buildings. Thus the size of the air conditioning ducts in the ceiling has a major influence on the number of levels or floors in the building, and hence on the rentable floor space.

Because perimeter induction units carry only primary treated air and do so at relatively high pressure, they are much smaller in cross-section than are the conventional supply air ducts. In one example in the city of Adelaide in South Australia, the use of an induction system to air condition the perimeter zones of the building allowed thirteen levels to be built within a height restriction appropriate to a conventional twelve story building.

The treated primary air streams in a perimeter induction system supply to the perimeter zone at least that quantity of pre-treated outdoor air which is required, by regulation or by best practice, to ventilate the zone. A common criterion used by designers is to require the primary air to offset heat which is transmitted through the perimeter walls and windows which bound the perimeter zone. The heat exchange means within the perimeter induction units which treat the induced secondary air are designed to offset all other loads which originate within the conditioned space of the perimeter zone including people, electrically powered devices, and lighting.

In addition to the abovementioned advantage of requiring less ceiling space than conventional air conditioning systems, induction systems require smaller and hence less expensive and less intrusive ducts to supply air from the primary air plant to each level of the building and to the conditioned space on each level. They do not require separate plant rooms which intrude into the potentially rentable space. Thus in terms of invested capital they are less expensive both to purchase and to install than are conventional air conditioning systems and they increase the proportion of the building which is counted as rentable space. Hence the return on investment can be larger than for conventionally serviced buildings. These advantages have in the past caused induction air conditioning systems to be preferred by many building owners and developers. Many such systems have been installed in buildings in many countries since the second world war.

Despite the apparent economic advantages of the system from the viewpoint of building developers, and from the viewpoint of building owners who pass on to their tenants the operating costs of the air conditioning, induction air conditioning systems have proved to be less than well received by tenants.

Because the induction units are located within the conditioned space, tenants are exposed to the noise generated by the primary air jets as they entrain the secondary air which is induced from the conditioned space to flow into the units through the heat exchange means. This noise has frequently been cause for complaint by tenants. Research by the Trane Company Inc (J. B. Custer, "*The economics and marketing of tenant comfort*", Proc. AIRAHFAIR-88, Sydney, AIRAH, 1988) has shown that discontent with the air conditioning, expressed through complaints about the operating cost, "staleness" of the air in the conditioned space, or the noise level, is one of the most common reasons reported by tenants for terminating a building lease. That research also showed that from the building owner's viewpoint, the cost of losing a tenant, finding and installing another is typically equivalent to approximately six months rental income from the leased space. Such losses can rapidly erode the advantage of the lower capital cost per unit of rentable area in the building.

A more important problem which magnifies tenant discontent is that in warmer climates the cooling capacity of that quantity of treated primary air which is required for ventilation is insufficient to offset the transmission load to the perimeter zone. Furthermore the quantity of secondary air which can be induced to flow through the secondary air heat exchange means by the jets supplying only ventilation air as the treated primary air is almost always inadequate to offset the internally generated load within the perimeter zone. Hence it has been necessary to increase the quantity of treated primary air both to offset the transmission load and to induce sufficient secondary air to flow through the secondary air heat exchange means to offset the loads generated within the perimeter zone. The increase of treated primary air is effected by increasing the pressure at which said primary air is supplied to the nozzles.

This increases the velocity at which the primary air is discharged from the nozzles. As indicated above, the noise generated by a jet is approximately proportional to the eighth power of its velocity.

Thus the increased cooling capacity is obtained at the direct cost of treating a greater quantity of hot and/or humid outdoor air. Another potential direct cost of the increased primary air pressure is tenant discontent due to the further increase in the noise radiated from the induction units into the conditioned space. For thirty years after the second world war the cost of energy remained low and operating costs were of small importance, thus the direct cost could be tolerated. That period was also one of rapid economic growth; office space was in short supply and hence tenants were unwilling to terminate a lease. Thus the inconvenience of the noise was tolerated. The very different economic climate of the 1990's with its surfeit of office space in many countries, higher cost of energy and growing concern about global warming has changed the situation substantially. Tenants find relocation both economically and environmentally attractive; owners find that while rental margins remain low and buildings are not fully occupied, operating costs are a serious concern.

To improve the occupational health of existing buildings equipped with induction air conditioning systems, and to improve their profitability for the owners of such buildings, it is an object of this invention to specify a nozzle and a means of profiling one or more of the boundaries of the confined space within existing induction air conditioning units in such manner that the interaction of the two will overcome the abovementioned problems. Similar principles are applicable also for new designs of induction air conditioning system and for the design of zone control boxes for conventional Variable Air Volume (VAV) systems.

It is a further object of the invention to specify a nozzle which can reduce the volume of noise generated at the outlet from a duct or at a change in the cross-section of a duct. More specifically, it is an object of the invention to increase the rate at which a primary air stream can induce a secondary air stream to flow through secondary air heat exchange means so to increase the effectiveness of induction air conditioning units and allow the velocity and hence the supply pressure of the primary air stream, and hence the noise generated by the jets, all to be reduced. As stated above, the noise generated by a jet is approximately proportional to the eighth power of the jet velocity. Hence it is apparent that a reduction in jet velocity can have a dramatic effect on the noise radiated from said induction air conditioning units or from VAV control boxes.

BRIEF SUMMARY OF THE INVENTION

In its broadest form, the invention is an induction air handling unit that uses a primary air flow to induce flow of secondary air through said air handling unit comprising, an induction chamber having an air flow entrance and an air flow exit, and a nozzle having an outlet located within said induction chamber, said nozzle being connected to a primary air flow that causes said secondary air flow to be induced through said induction chamber via said air flow entrance and out of said exit, said nozzle characterised by the edge forming said outlet having a scalloped shape.

Preferably, the nozzle design is used in conjunction with a profiled boundary or wall in a duct to promote both efficient mixing of a jet or jets of primary fluid with a surrounding fluid to form a mixture which diffuses into the surrounding medium, and a reduction in the volume of the noise which is generated during the mixing process. The profile of the nozzle at its outlet or exit plane is distorted to form a scalloped edge, preferably with five lobes in the case of an axisymmetric nozzle, or with a sinusoidal or rippled edge with a preferred spatial wavelength in the case of a nozzle which takes the form of a slot. Nozzles can be used solely or in groups to provide one or more streams of conditioned air with flow characteristics which cause the stream or streams to mix efficiently with surrounding air without creating an undesirable level of noise.

The volume of air which can be induced to flow from the surroundings into the induction unit via a heat exchange means is augmented relative to that achieved by existing induction system designs when use is made of a profiled wall, and the noise which is radiated into the occupied space within the building is simultaneously reduced.

The invention comprises at least one scalloped or multi-lobe nozzle, having any shape of the inlet cross-section which may be circular, rectangular or any other shape which then contracts smoothly to a scalloped or lobe-shaped outlet wherein the scalloping or lobes may take any convenient geometric form. The ratio of the perimeter length of said nozzle outlet to its outlet cross-sectional area is to be such as to achieve a higher than conventional rate of mixing between a primary stream of gas or liquid which emerges from said nozzle as a jet, and the surrounding gas or liquid within a confined or unconfined region into which it discharges; that is, to achieve a high rate of entrainment into the primary stream from the gas or liquid within said confined or unconfined space. In an induction air conditioning unit, the mixing and entrainment caused by the primary jet takes place within the confines of the induction unit. An increase in the rate at which said entrainment occurs is technically and commercially desirable, subject to manufacturing and cost constraints. The nozzle of the present invention has at least three and not more than ten lobes, but experiments by the inventors have shown that a five lobe nozzle provides an excellent result and it is now known that this configuration is compatible with new fundamental research on the form of distortion of a *Brown-Roshko vortex* which results in minimum noise generation when it amalgamates with a neighbour, as described above in relation to the work of Ko and Leung.

The preferred nozzle shape has a perimeter to cross-sectional area ratio which is equal to or greater than one point three times the perimeter to cross-sectional area ratio for a circle of the same area.

In some situations it is appropriate to use a linear or elongate slot-like nozzle rather than one which is disposed around the streamwise axis. If a square cross-section nozzle is employed, the ratio of the perimeter length to the cross-sectional area compared with that for a circular nozzle of the same cross-sectional area is 1.128, which is two divided by the square root of Pi. This same result applies for any rectangular cross-section. The effective perimeter to cross-sectional area of a generally linear/rectangular slot can be increased by scalloping the boundaries at the exit plane. For example, and without prejudice, for a slot with sinusoidal scalloping at its exit plane it is recommended that the peak-to-peak amplitude of the sinusoid divided by its wavelength should be between one and one point eight, with one point five being a preferred value. Again, a perimeter to outlet area ratio relative to that of an equivalent circular nozzle of the same cross-sectional area should be greater than one point three.

The location of said at least one nozzle in the induction air conditioning unit may be such as to allow the induction of secondary air from upstream, from downstream, or from both upstream and downstream relative to said location. The abovementioned increase in cooling capacity may be further increased by causing at least one boundary of the confined space within the induction unit to be formed to a profile which produces a minimum flow cross-section downstream from the location of said secondary air coil and preferably but not essentially also downstream from the location of said primary air nozzles. The throat so formed establishes the point of minimum pressure within the unit and from this point the mixture of the primary air and the induced secondary air diffuses toward the outlet from the unit to reach the pressure prevailing in the conditioned space. The greater the diffusion which can be achieved from the low pressure confined space within the unit to the prevailing pressure in the space into which the flow discharges, the lower will be the pressure within said confined space within the unit. The greater then will be the pressure difference across the secondary air coil. Hence the greater will be the quantity of air which can be induced to flow through said secondary air heat exchange means and so the greater will be the entrainment ratio and hence the cooling capacity of both the secondary air heat exchange means and the total capacity of the whole induction unit. The profiled boundary, and indeed other surfaces within the induction unit, can with advantage be designed and manufactured in a manner which can absorb and dissipate, through viscous damping, part of the noise which is incident upon them.

The contraction of said walls to a throat followed by their expansion as they approach the outlet from the unit generates the well known Venturi effect. The novelty of the use of the at least one profiled wall in the present invention is its use in conjunction with said primary air nozzles. By aligning the at least one profiled wall at the throat of the Venturi with the jet or jets from the primary air nozzle(s) a wall jet effect is created. A wall jet is a jet which flows tangentially to a boundary and thereby helps the boundary layer to maintain sufficient momentum to remain attached to the surface when it is moving into a region of rising static pressure. The wall jet effect also "captures" the jet so it continues to follow the wall as it diverges downstream from the throat. Such an arrangement allows the included angle between the diverging walls leading from the throat to the discharge plane to be increased without the flow separating from said diverging walls, and so achieving the degree of diffusion desired to maintain the low pressure within the unit. Where both walls contract towards and then diverge from said throat, each alternate jet from a line of nozzles can be aligned to cause a wall jet to form on each of the walls. By this combination of means the induction ratio and cooling capacity of the unit can be enhanced considerably and the exit velocity of the air leaving the unit can be kept low, so avoiding the creation of secondary noise such as the rattling of a vane in a supply air grille.

In addition to the improved entrainment and diffusion, the presence of at least one perforated profiled wall built with or without acoustically advantageous backing materials, causes a further reduction in the noise radiated from the induction unit over and above that achieved by the new nozzles alone (D. A. Bies, C. H. Hansen & G. E. Bridges, "*Sound attenuation in rectangular and circular cross-section ducts with flow and bulk reacting liner*", Jnl. of Sound & Vibration, 146, 1, pp 47–80, 1991).

In induction units where the secondary heat exchange means is located upstream from the primary air nozzles, the profiled side wall may be located between the secondary air heat exchange means and the primary air nozzles immediately upstream from the primary air nozzles. Such a profiled side wall must be designed, according to well established fluid dynamic principles, to inhibit closed-loop recirculations of the entrained secondary air which have been evident within the confined space in the units of this type which have been tested. Elimination of these recirculations increases the quantity of the secondary air which can be entrained through the secondary air heat exchange means. In conjunction with the upstream profiled side wall discussed above, at least one additional profiled side wall may be located downstream from the primary air nozzles.

Profiled side walls may be manufactured from suitably chosen, conventional sheet metal, or they may be formed from a perforated sheet metal plate with an area of perforation not exceeding 25% of a total area of the plate. The void behind the perforated profiled side wall may usefully be filled with a porous material chosen according to the principles established by D. A. Bies and published in the book by D. A. Bies and C. H. Hansen entitled, "Engineering Noise Control", Unwin-Hyman, London, 1988, to attenuate further the noise radiated from the unit. The density of the porous material should be at least 20 kg/m$^3$ and not greater than 50 kg/m$^3$. To minimise the possibility of particles of said porous material being discharged into the conditioned space it should be wrapped in a light, porous material such as nylon. A gap of at least five millimeters is necessary between the inside surface of the perforated profiled side wall and the outer wrapping of the porous material to obtain effective noise attenuation.

DETAILED DESCRIPTION OF THE INVENTION

The present invention will now be described in more detail by reference to a particular embodiment. The wall shape of the nozzle according to this embodiment was generated with the aid of a Computational Fluid Dynamics (CFD) software package to minimise the pressure drop across the nozzle. Design of the internal surface profile of the nozzle for manufacturing was generated by computer analysis. The profiled wall was designed, using the same CFD package as for the nozzle, to maximise the wall jet and venturi effects and hence to maximise, for the prescribed primary air flow rate, the induction of secondary air through the heat exchange means, in this case a chilled water tube and plate fin heat exchanger, into the induction air conditioning unit.

The embodiment described here and illustrated in the accompanying figures in which.

Figure 1:
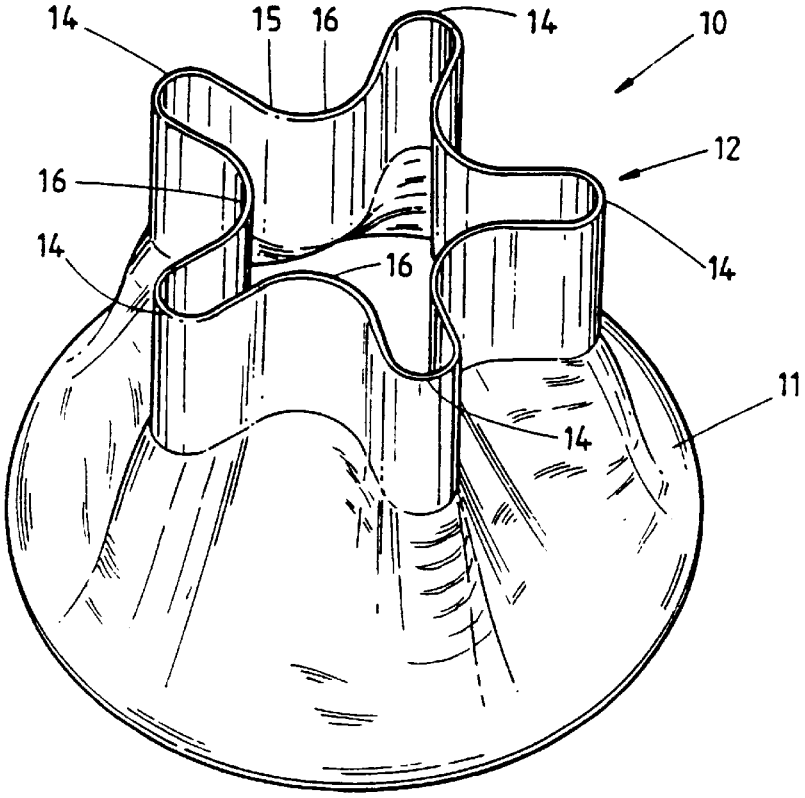
FIG. 1 shows a perspective view of a first multi-lobe nozzle.
Figure 2:
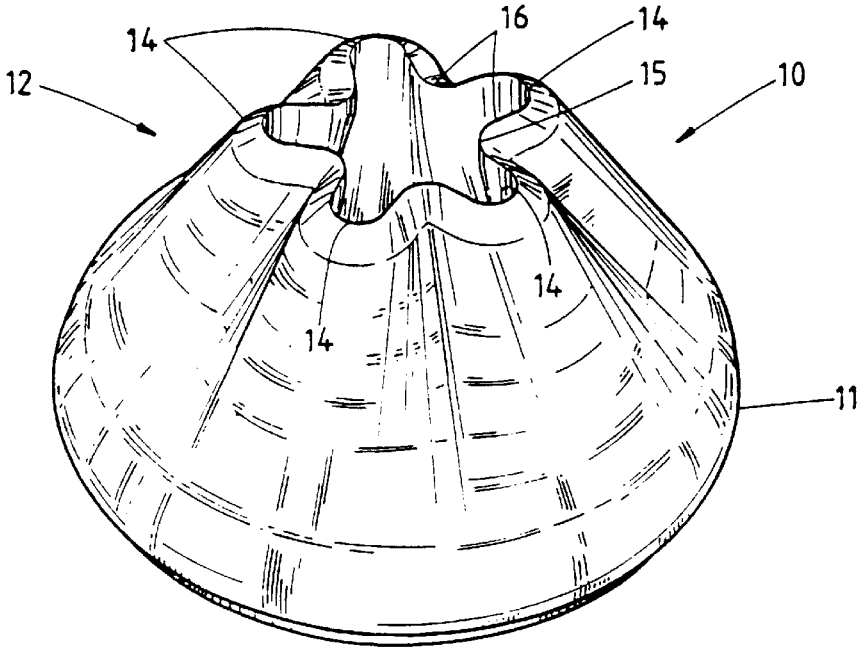
FIG. 2 shows a perspective view of a second multi-lobe nozzle.

FIG. 1 and 2 illustrate two variations of a nozzle 10 that are both subject of this invention. Each nozzle 10 comprises a lead-in portion 11 and a nozzle exit or outlet 12. The lead-in portion 11 is gradually shaped from a circular entrance to match the outlet shape 12 of the nozzle 10.

As shown in FIG. 1 and FIG. 2, each outlet 12 has a scalloped edge, which in this embodiment comprises five lobes 14 that are radially spaced around a central axis. Each outlet edge 15 is axisymmetric about this central axis. Therefore, the lobes 14 can be said to be generally arranged on a circular path. In addition to the lobes 14, the edge 15 comprises curved connecting sections between each pair of adjacent lobes 14. The embodiment shown in FIG. 1 and FIG. 2 uses five lobes 14.

Figure 3:
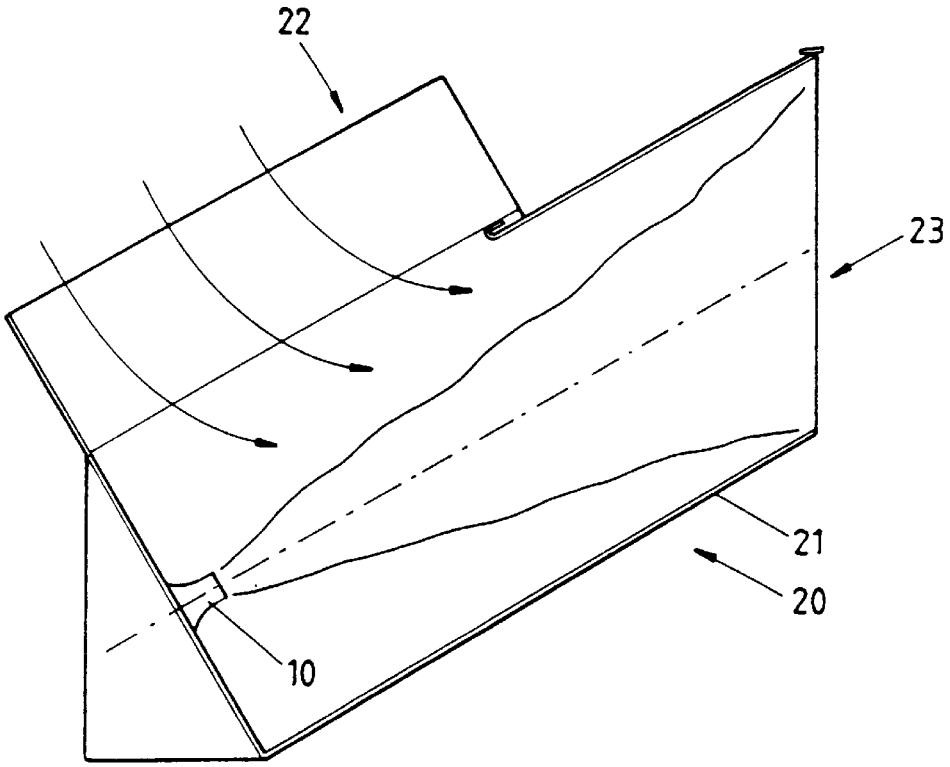
FIG. 3 shows a cross-sectional view of a prior art induction air handling unit.

FIG. 2 shows a moulded nozzle 10. FIG. 3 shows a pressed version. FIG. 1 illustrates the indicative shape of the internal surfaces of the nozzle 10 illustrated in FIG. 3.

FIG. 3 shows a typical induction air handling unit 20. It comprises an induction chamber 21 that normally comprises a series of sheet metal walls. There is an inlet 22, and an exit 23 the nozzle 10 is connected to a primary air source, and directs the primary air source into the chamber 21. The movement of the primary air source within the induction chamber 20 cause a secondary air flow resulting in air movement from the inlet 22 to the exit 23.

Figure 4:
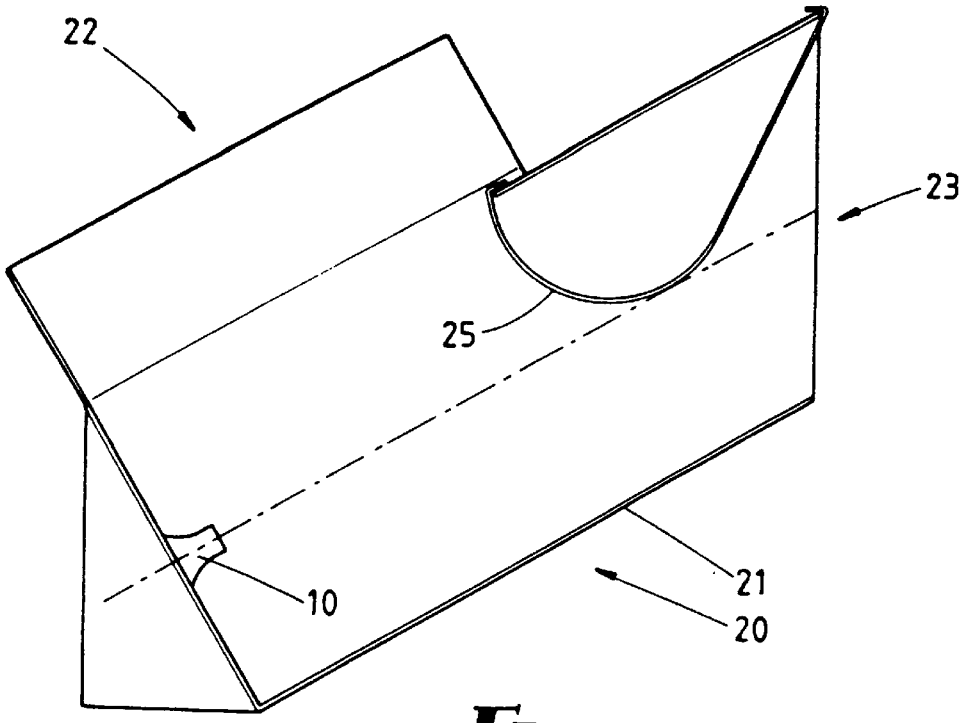
FIG. 4 shows a cross-sectional view of an induction air handling unit according to the present invention.

An embodiment according to this invention is illustrated in FIG. 4 in which a profiled wall 25 has been incorporated. The profiled wall 25 is positioned between the nozzle 10 and the exit 23 and is shaped so as to produce a venturi effect between the profiled wall and the remaining chamber walls 21. Where possible the jet from nozzle 10 may be aligned with the crest of profiled wall 25 to assist the diffusion of the flow as it approaches exit 23.

Figure 5:
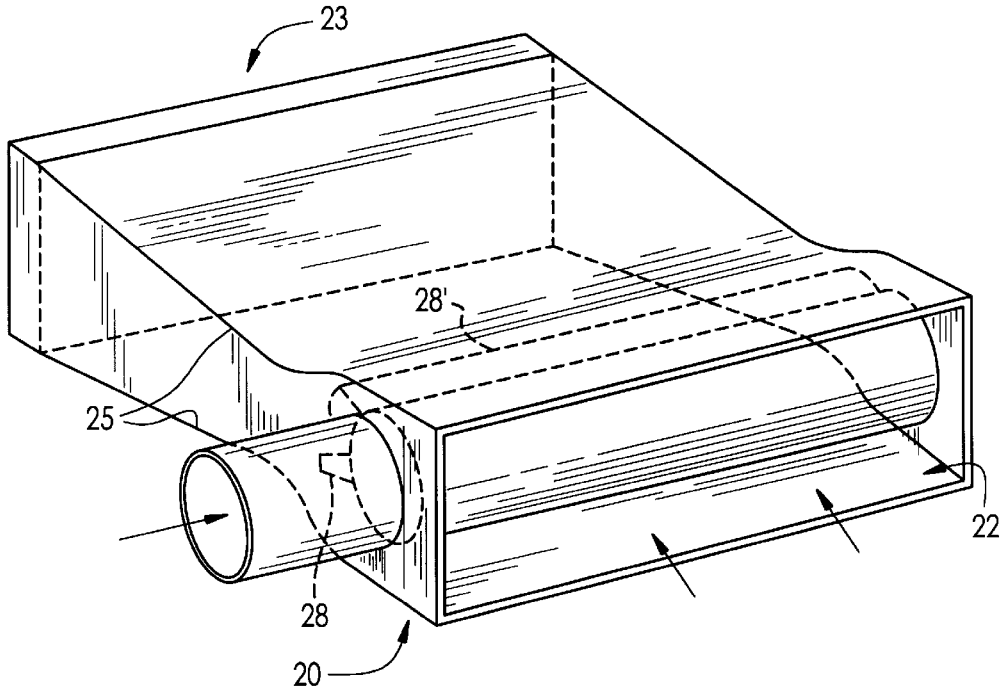
FIG. 5 shows a perspective view of an induction air handling unit with a pair of elongate slot-like nozzles.
Figure 5A:
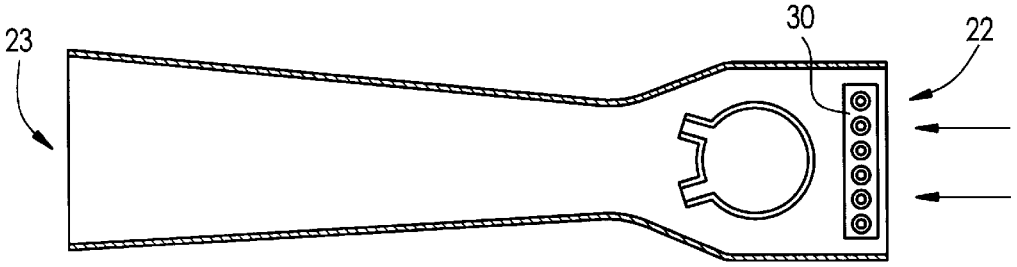
Figure 6:
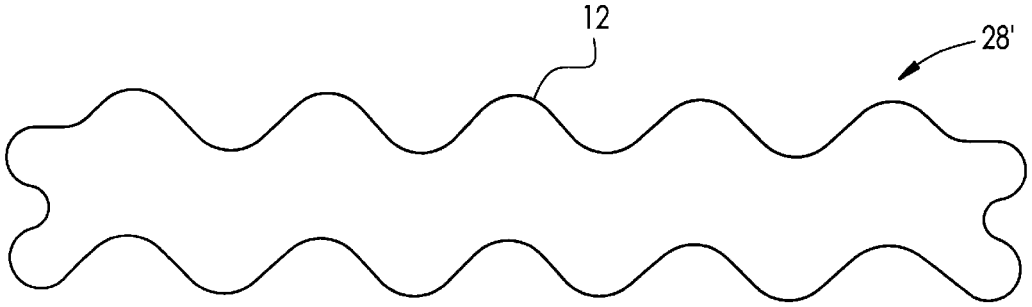
FIG. 6 shows a plan view of an outlet of an elongate slot-like nozzle.

FIG. 5 illustrates the use of the nozzle comprising an elongate slot-like aperture 28. In this embodiment, a pair of such nozzles 28 are used. FIG. 6 shows a plan view of the outlet 12 of the nozzle 20. Further, a pair of profiled walls 25 are positioned opposite one another within the chamber 20, and extend across the chamber 20 parallel with the elongate nozzles 28.

In the embodiment shown in FIG. 5, the chamber 20 is designed to have a heat exchanger positioned across the inlet 22. In addition, a further heat exchanger may also be positioned across the exit 23.

A very simple experimental apparatus was designed for testing the invention. It comprised a fan, flexible ducts, a variable speed drive and the induction unit. A Pitot tube connected to a digital manometer was used to measure both static and velocity pressure, a hot wire anemometer was used to measure the velocity of the secondary air at each of thirty locations covering the inlet face of the filter upstream from the secondary air induction coil, and condenser microphones connected to a sound pressure meter and sound analyser, all manufactured by Bruel and Kjaer, were used to measure the acoustic field. The fan and variable speed drive unit were located outside a large, calibrated reverberation chamber and the induction air conditioning unit was mounted within the reverberation chamber. This arrangement facilitated the measurements of total sound power radiated from the unit.

The experiment is devised in two separate sections; an acoustic experiment to measure the sound power radiated from the unit and a fluid mechanic experiment to measure the entrainment ratio and other features of the unit.

The aim of the acoustic experiment was to provide definitive measurements of the spectrum and the sound power level radiating from, first, the induction unit in its several standard configurations and, subsequently, from the same induction unit modified to incorporate individually and collectively the novel features described herein. Round section nozzles of two different sizes were tested in the unmodified induction unit to provide baseline data which could be compared with the specifications of the unit published by the manufacturer. The tests were repeated for full sets of each of two sizes of the multi-lobe nozzles. The experiments spanned a broad range of stagnation pressures in the plenum which is located within the unit upstream from the nozzles. The pressure in this plenum determines the flow velocity and the (primary air) flow rate through each set of nozzles. From the measured sound pressure level both the weighted sound pressure level and the radiated sound power level were calculated.

The fluid mechanic experiment provided information about the secondary and the primary air flows and therefore about the induction efficiency. The primary air flow through the nozzles was varied by using a variable speed drive to vary the speed of the fan. The measured data can be displayed in several ways but most instructive is as the relationship between the entrained air flow rate and the flow of the primary air through the nozzles.

The acoustic and fluid mechanic measurements were taken consecutively for each setting of the fan speed to improve the reliability of the intercomparisons between the data sets.

An indirect means of measuring the volume of the entrained secondary air was adopted. The experiment was performed so that the velocity of the secondary air induced through the induction unit could be measured at each of thirty locations on its inlet. The induced flow velocity was measured at each of the thirty locations. The large number of measurements was necessary because the velocity is not uniform across the inlet and because good accuracy was required to allow reliable estimates of the entrainment ratio to be calculated. The volumetric flow rate of the induced secondary air was calculated by summing the products of each elemental area of the surface and the velocity at its centre. The volumetric flow rate of the primary air (the air which is discharged through the nozzles) was measured by means of an orifice plate in the primary air supply duct. The results for the set of 25 nozzles have been averaged to yield an overall value of the entrainment ratio which can be used as a figure of merit. The entrainment ratio is the algebraic ratio of the volumetric flow rates of the induced and the primary air.

Velocity measurements show that the new nozzle design subject of this invention have significant advantages over the nozzle arrangements which are in common use in induction air conditioning units. The level of turbulence downstream from the nozzle outlets has been increased and this, combined with the larger perimeter of the jet, causes significantly greater entrainment of air from within the confined space within the unit, causing the pressure in that space to be lower than that which is achieved when the conventional nozzles are used. The reduced pressure increases the motive power for the entrainment of the secondary air through the induction heat exchange means. The increased mixing at the outlet from the primary air nozzles also causes the length of the potential core of each jet to be reduced with an accompanying reduction in the generation of noise.

Overall the concept has been to generate intensive mixing between the primary and the secondary air which augments the induction of the secondary air and reduces the noise generated by the primary air jets. Measurements have shown that the improvement in the entrainment is of the order of 19%–35%. This causes the volume of the secondary air that is drawn through the induction heat exchange means to be increased and hence the effectiveness of the induction heat exchange means is also increased. For a given volume flow rate of primary air the secondary coil capacity is, therefore, also increased by 19% to 35%.

Sound pressure measurements have been performed in the reverberation chamber in the Department of Mechanical Engineering, The University of Adelaide. These chambers are built to best available world standards and have hosted much internationally respected research in the fields of acoustics and vibration.

The sound pressure measurements have shown significant reductions of sound pressure and of sound power levels. Considering the spectrum of the sound, for a given flow of the primary air through the induction unit, the spectral noise components measured in octave frequency bands with the new nozzles fitted are from 1 to 7 decibels lower, depending on the band, than with the original circular nozzles. With one only acoustically absorbing perforated side wall in place the noise from the unit is reduced by up to 15 dB-A.

EXAMPLE

A comparison between the conventional round nozzle and the improved five lobe nozzle design, assuming that the secondary air heat exchange means can accept an increased rate of coolant flow to accommodate the increase in cooling capacity associated with the increased secondary air flow rate.

Assume

Pst=350 Pa in the primary air plenum

Round Nozzles

| Primary air | Secondary air |
|---|---|
| Vp = 36.8 L/s<br>Qp = 446.3 W (Watts of cooling) | Qs = 1000 W |

Total unit capacity is Q=Qs+Qp=1446.3 W.

Five Lobe Nozzles

| Primary air | Secondary air |
|---|---|
| Vp = 36.8 L/s<br>Qp = 446.3 W | Qs = 1.23 × 1000 W = 1230 W |

Total unit capacity is Q=Qp+Qs=1676 W, which is 16% more than that achieved by the round nozzles.

The addition of a profiled shape on only one wall downstream from the five lobe nozzles allows further gains to be made in the performance of the unit. Over the primary air pressure range tested the increase in the entrainment of the secondary air is 6.5%–10% compared with the operation of the unit with only the five lobe nozzles and no profiled wall. If we assume that the increase in the entrainment of secondary air is 8%, the increase in the capacity of the unit is as shown in the following table:

| Primary air | Secondary air |
|---|---|
| Vp = 36.8 L/s<br>Qp = 446.3 W | Qs = 1.08 × 1230 = 1330 W |

Total unit capacity is then Q=Qp+Qs=1776 W, which is 23% more than that achieved by the round nozzles. The total increase in the entrainment of secondary air through the heat exchange means is 32% compared with the original unit design.

If we now reduce the pressure upstream from the nozzles to Pst=300 Pa for the five lobe nozzles operating with one profiled wall we find the following:

| Primary air | Secondary air |
|---|---|
| Vp = 34.21 L/s<br>Qp = 415 W | Qs = 1192 W |

Total unit capacity is Q=Qp+Qs=1607 W, which is 11% more than for base case with round nozzles (which is more than was required for the particular application)! The sound pressure level is reduced by 3-p4 dB(A), which is noticeable. The primary air supply pressure could if desired, be reduced by a further 15–20 Pa to obtain the maximum reduction in the noise while still maintaining the original cooling capacity. However experience shows that the cooling capacity of the majority of perimeter induction systems now in service is less than that which modern design practice would deem to be necessary. The decision on whether to maximise the noise reduction or to provide the increased cooling is a matter for professional judgement in each situation considered. The present invention allows that judgement to be exercised.

In some existing buildings, either because additional cooling capacity has been required, or because changes to the primary air supply ductwork have unbalanced the supply air pressures, primary air pressures in the range from 500 Pa to 600 Pa are being employed. In these cases reduction of the primary air pressure by 100 Pa reduces the primary air supply by about 10–12% without reducing the cooling capacity when the nozzle of this invention is used, the reduction of primary air cooling capacity being offset by increased secondary air cooling capacity. The associated noise is reduced by between 7 dB(A) and 10 dB(A) for such a building.

SUMMARY OF RESULTS

With the new nozzle concept proposed in this invention and with the new profiled wall section installed in the units, the entrainment is significantly increased and electrical power is saved because the fan and motor of the primary air treatment plant do not have to raise the full basic quantity of primary air to such a high pressure. Because the required primary air flow is conservatively only 80% of that required by the basic units, chiller (or boiler) load is reduced. Some additional power is consumed in pumping the additional water to the secondary induction coils. Overall, the total capacity of the air-conditioning system can be increased without additional electrical energy because some primary air capacity is transferred to the secondary air heat exchange means so effectively transferring that portion of the load from the air circuit to the water circuit. It is concluded that typical values which can be claimed for these savings, and for the reductions in the noise from the units, are as follows:

ENERGY SAVINGS

The supply fan will operate with 20% less primary air against a pressure head which is decreased by 30%. Its motor will therefore consume substantially less electrical power.

The chilling plant will be required to cool 20% less primary air. The additional pumping power required to circulate the additional water to the secondary air heat exchange means is small compared with the above savings.

NOISE REDUCTION

The new nozzle design operating in conjunction with the profiled duct boundary, together with the decreased primary air flow, will reduce the noise radiated from the induction unit by at least 7 dB in the absence of any acoustic treatment means, and up to 15 dB with such means.

SUMMARY

The reduction in primary air cooling capacity which accompanies the reduction in the primary air flow is fully offset by a modest increase in the chilled water flow to the secondary air heat exchange means to cool the additional secondary air which is entrained by the combined effects of the new five lobe nozzles and the profiled side wall within the unit.

While the present invention has been described in terms of preferred embodiments to facilitate better understanding of the invention, it should be appreciated that various modifications can be made without departing from the principles of the invention. Therefore, the invention should be understood to include all such modifications within its scope.

What is claimed is:

1. An induction air handling unit that uses a primary air flow to induce flow of secondary air through said air handling unit, said air handling unit comprising:

an induction chamber having an air flow entrance and an air flow exit; and a nozzle having an outlet located within said induction chamber;

said nozzle being connected to a primary air flow that causes said secondary air flow to be induced through said induction chamber via said air flow entrance and out of said exit;

said nozzle having a scalloped-shaped edge forming said outlet.

2. An induction air handling unit according to claim 1 wherein said scalloped edge is formed by a plurality of connected lobes.

3. An induction air handling unit according to claim 1 wherein said nozzle outlet is an elongate substantially slot-like aperture.

4. An induction air handling unit according to claim 1 wherein said scalloped edge is arranged on a circular path.

5. An induction air handling unit according to claim 2 wherein said lobes are radially spaced around a circular path.

6. An induction air handling unit according to claim 5 wherein said nozzle comprises at least three lobes.

7. An induction air handling unit according to claim 5 wherein said nozzle comprises five lobes.

8. An induction air handling unit according to claim 1 wherein said nozzle outlet is an elongate substantially slot-like aperture, and wherein said scalloped edge is formed by a sinusoidally shaped edge.

9. An induction air handling unit according to claim 1 further comprising a plurality of said nozzles.

10. An induction air handling unit according to claim 1 further comprising at least one profiled surface between said nozzle and said air flow exit that forms a venturi throat.

11. An induction air handling unit according to claim 10 wherein there is one profiled surface.

12. An induction air handling unit according to claim 10 wherein two profiled surfaces are arranged opposite one another.

13. An induction air handling unit according to claim 10 wherein said profiled surface comprises a venturi having generally circular cross-section of varying diameter along its length.

14. An induction air handling unit according to claim 1 wherein heat exchange coils are positioned prior to said air flow entrance.

15. An induction air handling unit according to claim 2 wherein said nozzle outlet is an elongate substantially slot-like aperture.

* * * * *